US005375704A

United States Patent [19]

Focke et al.

[11] Patent Number: 5,375,704

[45] Date of Patent: Dec. 27, 1994

[54] HINGE-LID PACK, ESPECIALLY FOR CIGARETTES

[75] Inventors: Heinz Focke, Verden; Henry Buse, Visselhövede, both of Germany

[73] Assignee: Focke & Co. (GmbH & Co.), Verden, Germany

[21] Appl. No.: 136,043

[22] Filed: Oct. 14, 1993

[30] Foreign Application Priority Data

Nov. 6, 1992 [DE] Germany ..... 4237523

[51] Int. Cl.[5] ..... B65D 85/10

[52] U.S. Cl. ..... 206/268; 206/265; 206/831

[58] Field of Search ..... 206/265, 268, 271, 273, 206/275, 254, 831

[56] References Cited

U.S. PATENT DOCUMENTS

| | | | |
|---|---|---|---|
| 2,346,407 | 4/1944 | Wright | 206/254 |
| 2,415,117 | 2/1947 | Tamarin | 206/254 |
| 3,011,630 | 12/1961 | Lubash . | |
| 3,219,253 | 11/1965 | Davis | 206/831 |
| 3,695,422 | 10/1972 | Tripodi | 206/831 |
| 4,042,110 | 8/1977 | Guernsey | 206/831 |
| 5,035,935 | 7/1991 | Thomas et al. | 206/831 |
| 5,137,148 | 8/1992 | Evers | 206/271 |
| 5,160,024 | 11/1992 | Evers | 206/268 |
| 5,236,084 | 8/1993 | Evers | 206/273 |

FOREIGN PATENT DOCUMENTS

| | | |
|---|---|---|
| 476882 | 3/1992 | European Pat. Off. . |
| 1809476 | 1/1960 | Germany . |
| 7826336 | 12/1978 | Germany . |
| 8221855 | 12/1982 | Germany . |
| 3634489 | 4/1987 | Germany . |
| 2238770 | 6/1991 | United Kingdom . |

*Primary Examiner*—David T. Fidei

*Attorney, Agent, or Firm*—Sughrue, Mion, Zinn, Macpeak & Seas

[57] ABSTRACT

A hinge-lid pack (10) for cigarettes or similar items is provided with a printing carrier (28) made of a separate blank and intended to accommodate pieces of information, advertisements, etc. The printer carrier (28) is arranged at the hinge-lid pack (10) such that a portion, namely the anchoring portion (29, 32), is located on the inner side of the lid (12), and another portion, namely a visible portion (30), projects from the hinge-lid pack and abuts the front wall (31) of the pack. The anchoring portion (29, 32) of the printing carrier (28) is severably anchored to the lid (11) by restraining the printing carrier between the lid corner tabs (19, 20) and a lid top wall (21).

7 Claims, 2 Drawing Sheets

FIG. 3
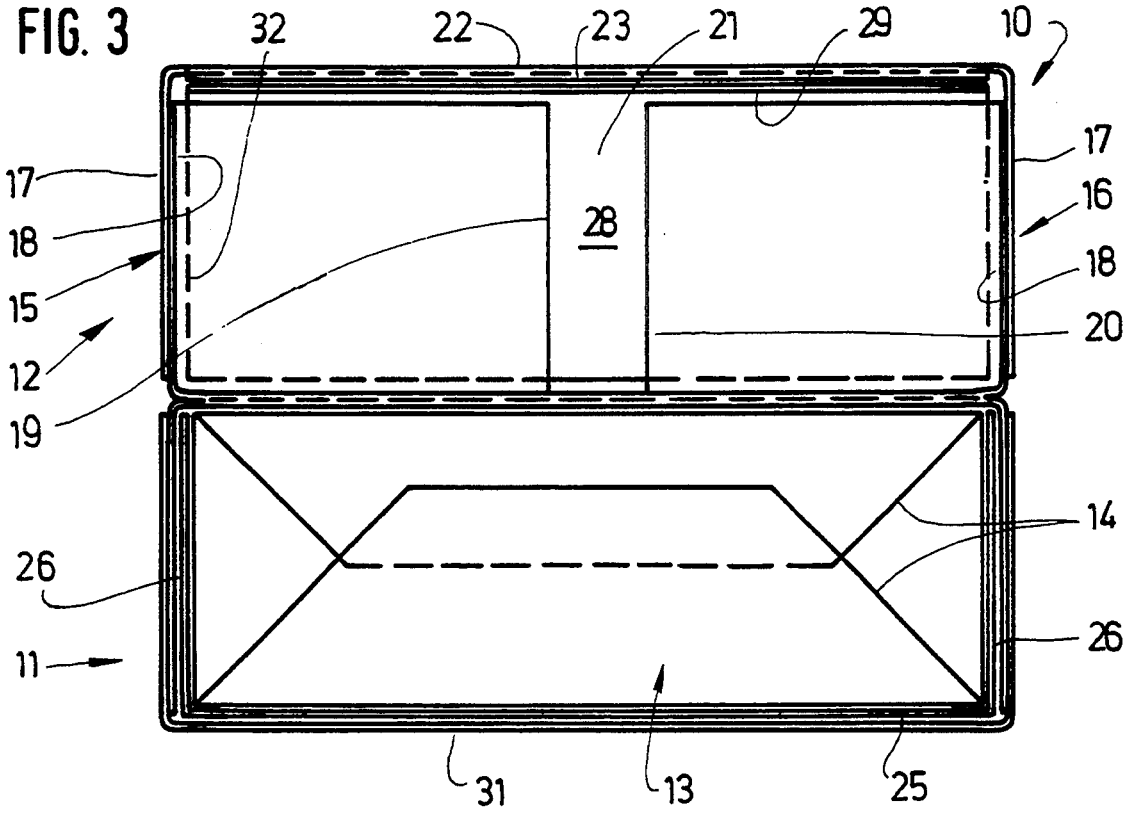
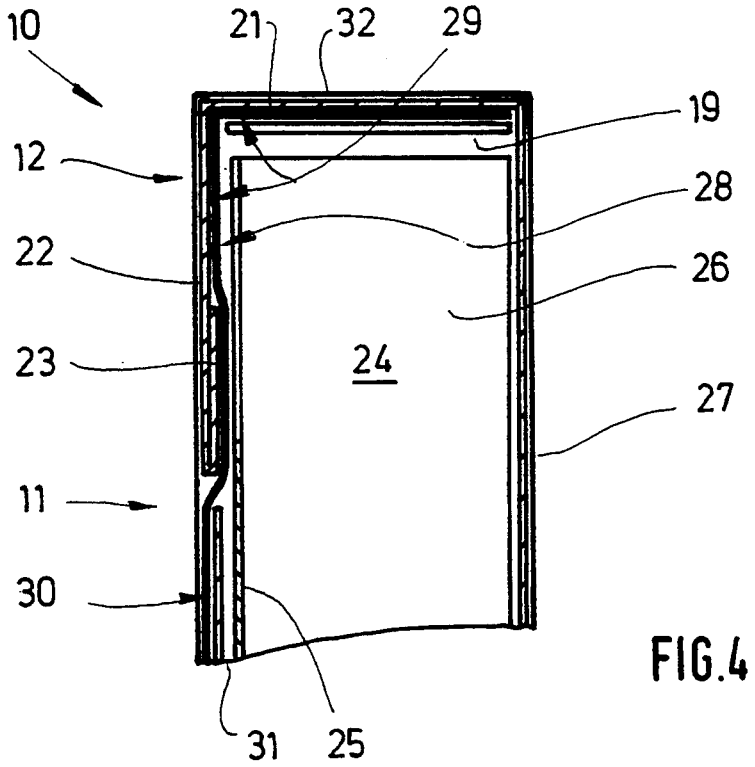
FIG.4

HINGE-LID PACK, ESPECIALLY FOR CIGARETTES

BACKGROUND OF THE INVENTION

The invention relates to a pack with a lid, especially a hinge-lid pack for cigarettes with a pack part and a hinged lid connected thereto.

Hinge-lid packs are known worldwide as cigarette packs. A cigarette group is surrounded by an inner wrapping made of tin foil or of paper. The hinge-lid pack consists of a pack part and a hinged lid connected to the rear of the pack part. In closed position the pack part and lid lie in an aligned manner along a closing edge in the region of a front wall and in the region of a side wall. The pack is conventionally fitted with an outer wrapping made of transparent foil or plastic foil.

With this kind of pack there is increasing demand to arrange pieces of information for the consumer on separate printing carriers. This information can be in the form of advertisements, factual information but also coupons or entry-tickets for performances. A hinge-lid pack for cigarettes is by nature hardly suitable for arranging this kind of printing carrier.

SUMMARY OF THE INVENTION

The invention is based on the object of designing packs with lids, especially hinge-lid packs for cigarettes, so that a printing carrier in the form of a label or something similar can be arranged on the pack or in the pack in a sensible manner and so that it can be seen from the outside when the pack is closed.

To attain this object the pack according to the invention comprises a printing carrier made of a separate blank with an anchoring portion arranged on the inner side of the lid and another visible portion that projects from the pack over a closing gap between pack part and lid.

In the embodiment of the pack according to the invention, the printing carrier consisting of a separate blank is arranged partly on the inside and partly on the outside of the pack. Therefore, it can be seen from outside if there is a printing carrier even prior to using the pack. The outer wrapping made of plastic foil conventionally used for hinge-lid packs for cigarettes also leaves visible the printing carrier or the part projecting from the hinge-lid pack.

According to the invention, the anchoring portion of the printing carrier is severably fixed to the pack or to the lid. The printing carrier can be fixed to the inner side of the lid with glue points, for example. Other than this or in addition to this an end portion of the anchoring portion can be anchored to the inner side of the lid by means of folding tabs, for example by means of lid corner tabs conventional to hinge-lid packs which abut the inner side of the lid top wall. According to the invention the end portion of the anchoring portion is fixed between the two lid corner tabs on the one side and the lid top wall on the other.

An exemplary embodiment of the hinge-lid pack according to the invention is explained in more detail below with reference to the drawings. In these:

BRIEF DESCRIPTION OF THE DRAWING

FIG. 3 shows a topview of a hinge-lid pack in opened position, on an enlarged scale, FIG. 4 shows a vertical section through the upper area of a hinge-lid pack in closed position.

DESCRIPTION OF A PREFERRED EMBODIMENT

Figure 1:
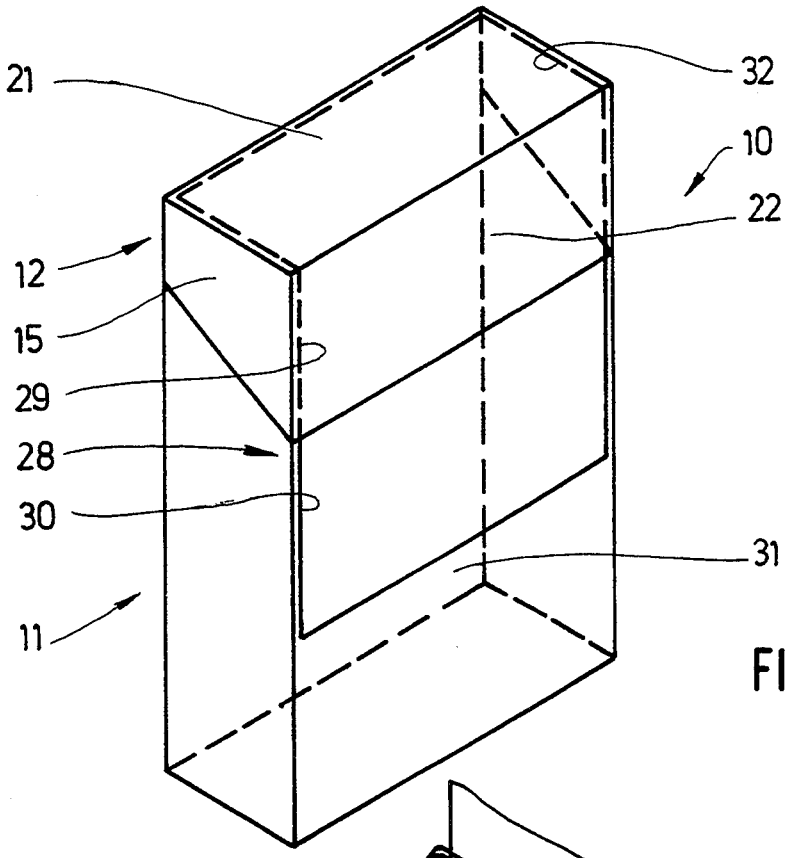
FIG. 1 shows a hinge-lid pack with printing carrier in closed position in a perspective view
Figure 2:
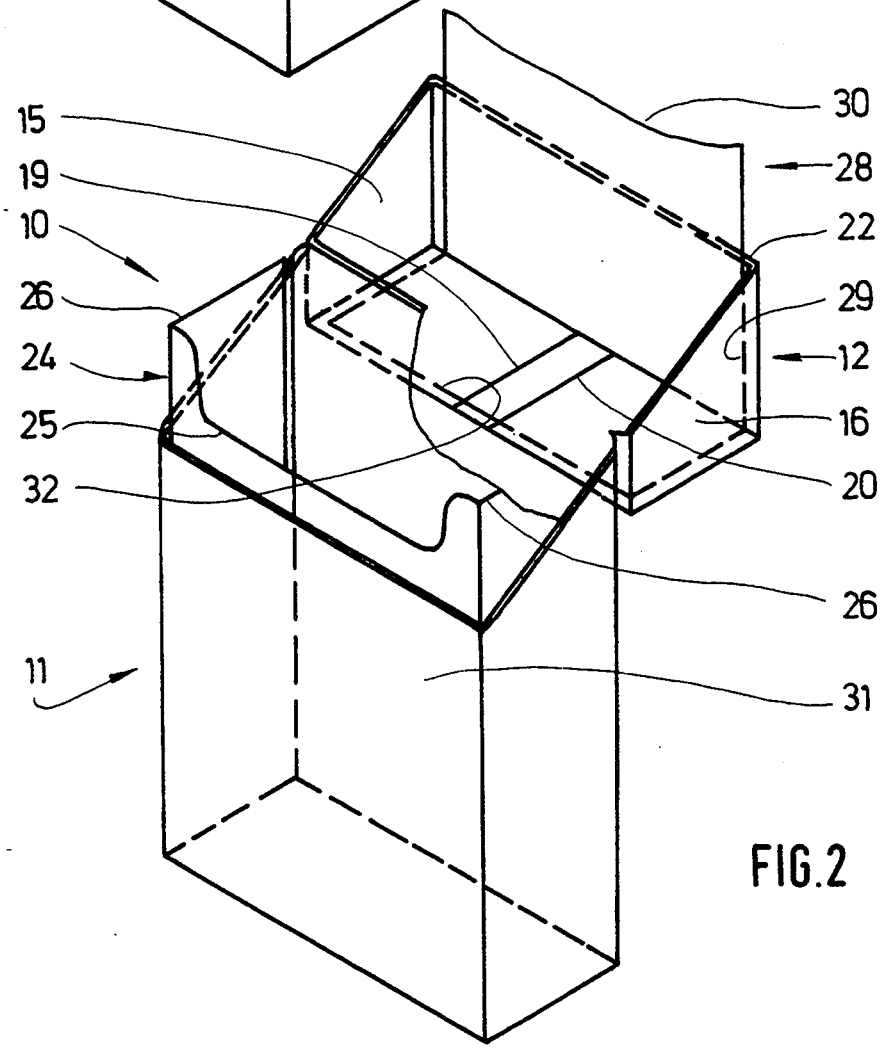
FIG. 2 shows the hinge-lid pack according to FIG. 1 opened position, also in a perspective view.

In the drawings a hinge-lid pack 10 is shown as a preferred embodiment. This pack consists, as is generally known, of a pack part 11 and a lid 12. The overall cuboidal hinge-lid pack 10 serves for accomodating a cigarette group that forms a cigarette block 13 and is surrounded by an inner wrapping made of tin foil or paper. The cigarette block 13 formed in this manner sits with its major, lower portion in the pack part 11. The upper part projecting from the pack part is covered by a lid 12 in closed position.

Pack part 11 and 12 consist of a single blank made of thin cardboard. The lid is folded so that the lid side walls 15, 16 consist of joined lid side tabs 17, 18. Lid corner tabs 19, 20 are connected to each of the interior lid side tabs 18 of lid side walls 15, 16. The two lid corner tabs 19, 20 abut the inside of a lid top wall 21.

A lid front wall 22 is provided with an inwardly arranged lid inner tab 23. On the upper portion of the pack part there is an equally conventional collar 24 with collar front wall 25 and collar side tab 26. An upper portion of the collar 24 projects from the pack part 11.

The hinge-lid pack designed in this manner is conventionally surrounded by an outer wrapping made of transparent foil or plastic foil.

The pack described in the foregoing is equipped with a printed label, namely a printing carrier 28. In the present case the printing carrier has a rectangular shape and corresponds in width approximately to the inside dimension of the hinge-lid pack 10. Furthermore, printing carrier 28 is proportioned and arranged so that a portion of it, namely the anchoring portion 29, extends across the inside of the pack, that is across the inside of the lid when the pack is in closed position and prior to using. The remaining portion, that is a visible part 30, projects from the closed hinge-lid pack 10 and is visible from the outside. This visible part 30 abuts the outer side of a front wall 31 of the pack part 11. The visible part is thus perceptible from the outside even if a transparent outer wrapping 27 is present.

The printing carrier 28 is severably anchored to the inner side of the hinge-lid pack. In the present embodiment the printing carrier 28 extends across the full width of the inner side of the lid front wall 22 and the lid inner tab 23 as well as across the inner side of lid top wall 21. The printing carrier 28 or its anchoring part 29 are fixed thereto by folding tabs of hinge-lid pack 10. These folding tabs are the corner tabs 19, 20. The anchoring portion or an end portion 32 that extends across a region of the lid top wall 21 lies between the lid top wall 21 and the two lid corner tabs 19, 20 and is restrained there accordingly.

When the hinge-lid pack 10 is opened the printing carrier 28 is at first held by the lid. However, the printing carrier can very easily be drawn out of its anchoring in the region of the lid top wall 21. Conventionally, the printing carrier 28 is taken from the pack when opened for the first time and then used and disposed of.

The printing carrier 28 can also be severably fixed to the anchoring portion 29 in a different way, especially with small glue points. For example, the printing carrier 28 can be provisionally fastened to the inner side of the lid front wall 22, but also—with its rear side—to a portion of the collar front wall 25 projecting from pack part 11.

The printing carrier 28 consists of a thin-walled material that is appropriate for printing, especially paper, (plastic or tin) foil or thin cardboard.

We claim:

1. In a hinge-lid pack (10) for cigarettes which is formed from a first blank, and which has a pack part (11) and a hinged lid (12) connected thereto, said pack having a lid-closed position and a lid-open position, the improvement comprising a printing carrier (28) formed from a second, different blank made of thin-walled material selected from a group consisting of paper, foil and thin cardboard; said printing carrier (28) comprising an anchoring portion (29), disposed on an inner side of the lid, and a visible portion (30) projecting from the closed pack through a closing gap between pack part (11) and lid (12) in said lid-closed position;

wherein the anchoring portion (29) is severably anchored on the inner side of the lid (12); and wherein the visible part (30) abuts a front wall (31) of pack part (11) without being fixed to the front wall; and wherein the anchoring portion (29) is inwardly severably anchored to the hinge-lid pack (10) by glue.

2. Pack according to claim 1, wherein the visible portion (30) of the printing carrier (28) abuts the front wall (31) of the pack part (11) in said closed position; and said pack further comprises an outer wrapping (27) made of transparent foil and surrounding the visible portion (30).

3. In a hinge-lid pack for cigarettes which is formed from a first blank, and which includes a pack part (11), a hinged lid (12) connected to said pack, and a collar (24) which has a lower portion anchored in the pack part (11) and an upper portion which is located inside of said lid (12) in a closed position of said lid (12), the improvement which comprises:

a) a removable printing carrier (28) located on said pack, b) wherein the printing carrier (28) is formed from a second, different blank that is independent of the hinge-lid pack (10), and that is made from thin-walled material selected from a group consisting of paper, foil and thin cardboard, c) wherein the printing carrier is releasably anchored inside of the lid (12) by an anchoring portion (29) of said carrier, and extends at least between a front wall (22) of the lid and a front wall (25) of the collar when the lid is closed, d) wherein the priming carrier (28) has a lower visible portion (30) which projects outside of the closed hinge-lid pack through a closing gap between the pack part (11) and the lid (12), and e) wherein the visible portion (30) adjoins a front wall (31) of the pack part (11) without being connected to the front wall (31).

4. Pack as claimed in claim 3, wherein the visible portion (30) of the priming carrier (28) is surrounded by an outer wrapping (27) made from transparent foil.

5. Pack as claimed in claim 3 or 4, wherein the anchoring portion (29) of the priming carrier (28) adjoins the lid from wall (22) and an upper lid wall (21) inside of the lid (12).

6. Pack as claimed in claim 3, wherein an end portion (32) of the anchoring portion (29) is located between the upper lid wall (21) and lid corner tabs (19, 20), and the lid corner tabs (19, 20) are connected to inward lid side tabs (18) of lid side walls (15, 16).

7. Pack as claimed in claim 3, wherein the anchoring portion (29) of the printing carrier (28) is releasably fixed by adhesive bonds inside of the lid (12) on the lid front wall (22).

* * * * *